United States Patent [19]

Huang et al.

[11] Patent Number: 4,700,779

[45] Date of Patent: Oct. 20, 1987

[54] PARALLEL HORIZONTAL WELLS

[75] Inventors: Wann-Sheng Huang; Margaret A. Hight, both of Houston, Tex.

[73] Assignee: Texaco Inc., White Plains, N.Y.

[21] Appl. No.: 794,369

[22] Filed: Nov. 4, 1985

[51] Int. Cl.[4] ..... E21B 43/24; E21B 43/30

[52] U.S. Cl. ..... 166/263; 166/50; 166/245; 166/272

[58] Field of Search ..... 166/50, 263, 245, 272

[56] References Cited

U.S. PATENT DOCUMENTS

| | | | |
|---|---|---|---|
| 3,042,114 | 7/1962 | Willman | 166/272 |
| 3,705,625 | 12/1972 | Whitten et al. | 166/363 X |
| 3,994,340 | 11/1976 | Anderson et al. | 166/50 X |
| 4,260,018 | 4/1981 | Shum et al. | 166/272 |
| 4,417,620 | 11/1983 | Shafir | 166/245 |
| 4,463,988 | 8/1984 | Bouck et al. | 299/2 |
| 4,466,485 | 8/1984 | Shu | 166/272 |
| 4,491,180 | 1/1985 | Brown et al. | 166/272 |
| 4,510,997 | 4/1985 | Fitch et al. | 166/50 X |
| 4,515,215 | 5/1985 | Hermes et al. | 166/272 |
| 4,574,884 | 3/1986 | Schmidt | 166/272 X |
| 4,577,691 | 3/1986 | Huang et al. | 166/272 |
| 4,598,770 | 7/1986 | Shu et al. | 166/272 X |

*Primary Examiner*—George A. Suchfield
*Assistant Examiner*—David J. Bagnell
*Attorney, Agent, or Firm*—Jack H. Park; Kenneth L. Priem; Harold J. Delhommer

[57] ABSTRACT

The disclosed invention is a method of recovering hydrocarbons through parallel horizontal wells by use of steam and water injection. Steam is injected into two parallel horizontal wells to stimulate the formation and then the second horizontal well is converted to a production well. About the time of steam breakthrough at the second well, the steam injection at the first well is converted to water injection, production is suspended from the second well, and steam is injected through the second and third wells. After a suitable period of stimulation time, the third well is converted to a producing well, steam injection is continued through the second well, and water injection is continued through the first well.

7 Claims, 2 Drawing Figures

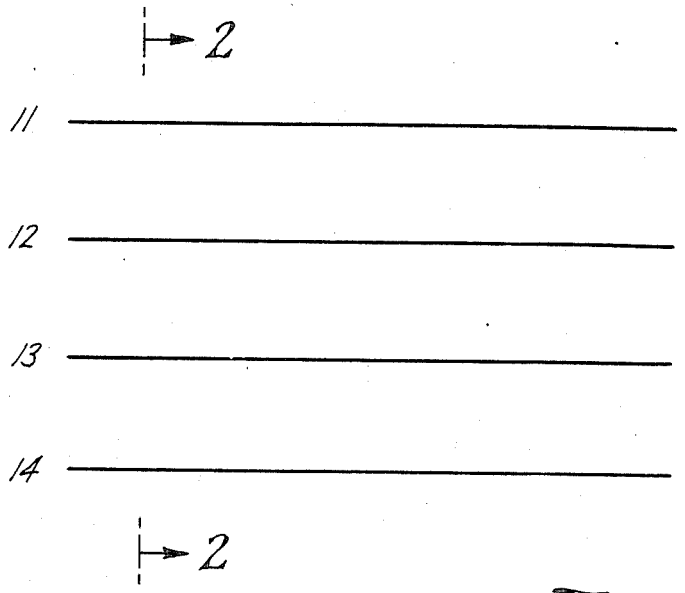
Fig. 1
Fig. 2
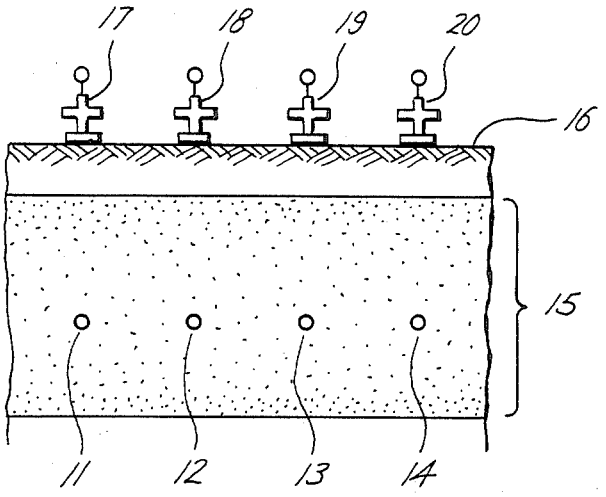

PARALLEL HORIZONTAL WELLS

BACKGROUND OF THE INVENTION

The invention process is concerned with the enhanced recovery of oil from underground formations. More particularly, the invention relates to a thermal method for recovering hydrocarbons with parallel horizontal wells.

Horizontal wells have been investigated and tested for oil recovery for quite some time. Although horizontal wells may in the future be proven economically successful to recover petroleum from many types of formations, at present, the use of horizontal wells is usually limited to formations containing highly viscous crude. It seems likely that horizontal wells will soon become a chief method of producing tar sand formations and other highly viscous oils which cannot be efficiently produced by conventional methods because of their high viscosity. Most heavy oil and tar sand formations cannot be economically produced by surface mining techniques because of their formation depth.

Various proposals have been set forth for petroleum recovery with horizontal well schemes. Most have involved steam injection or in situ combustion with horizontal wells serving as both injection wells and producing wells. Steam and combustion processes have been employed to heat viscous formations to lower the viscosity of the petroleum as well as to provide the driving force to push the hydrocarbons toward a well.

A system of using parallel horizontal wells drilled laterally from subsurface tunnels into the lower portion of a tar sand formation is disclosed in U.S. Pat. No. 4,463,988. The described process injects a displacing means such as steam into the boreholes to cause hydrocarbons to flow into the lower portion of the lateral boreholes and be produced to the surface.

U.S. Pat. Nos. 4,491,180 and 4,515,215 describe the conversion of steam injection into water injection in viscous oil recovery processes. U.S. Pat. No. 4,260,018 discloses a method for steam flooding a dipping formation from the updip end to the downdip end. This process injects hot water through separate injection wells located between the steam bank and the outcrop end of the reservoir to act as a buffer zone to prevent steam from escaping the formation.

FIGS. 1, and 2 illustrate the practice of the invention on substantially parallel horizontal wells. FIG. 1 is a top view and FIG. 2 is a side view along line 2—2 of FIG. 1.

SUMMARY OF THE INVENTION

The invention is a method of recovering hydrocarbons through parallel horizontal wells by use of steam and water injection. The invention employs substantially parallel horizontal wells as both injection and production wells by creating and moving a steam and water flood front through the reservoir. The flood front is initiated by injecting steam into two substantially parallel horizontal wells, preferably on one edge of the formation, and then converting the second horizontal well after some period of time to a production well. About the time of steam breakthrough at the second well, the steam injection at the first well is converted to water injection, production is suspended from the second well and steam is injected through the second and third wells. After a suitable period of stimulation time, the third well is converted to a producing well, steam injection is continued through the second well and water injection is continued through the first well.

This process may be employed to sweep an entire formation by repeating the process for as many horizontal wells as desired. The invention is particularly suitable for thin viscous oil reservoirs having a thickness of less than about 30 feet which are difficult to economically produce by other methods.

DETAILED DESCRIPTION

The invention provides a process for creating and sweeping a reservoir with a steam and water flood front. To practice the invention, multiple, substantially parallel wells must be drilled and completed in the underground formation, with at least a portion of said wells extending through the formation in a substantially horizontal direction. Preferably, the wells will start at one edge of the formation. It is most preferred that this edge of the formation be a natural boundary so that the flood front will move in one general direction away from the natural boundary.

Four substantially parallel horizontal wells will be used in the example procedure. It should be kept in mind that fewer than four wells or substantially more than four horizontal wells may be used in the practice of the invention.

Four wells are drilled and completed into an underground hydrocarbon formation, with a portion of said wells extending through the formation in a substantially horizontal direction. The second well is positioned in the formation between the first and third wells and the third well is positioned between the second and fourth wells. It is not necessary that the well spacings be equal.

Steam is initially injected into the formation through the first and second wells. After a suitable period of time, the second well is converted to a producing well and steam injection is continued at the first well. The purpose of initially injecting steam through a well and then converting the well to a production well is to lower the viscosity of the viscous hydrocarbons around such a well and permit the well to become an attractive producer in the future. Steam injection is continued through the first well and production continued from the second well until just prior or sometime after the time of steam breakthrough at the second well.

About the time of steam breakthrough at the second well, the first well is converted to water injection and production is ceased at the second well. Steam is then injected through the second well and the third well to further stimulate the formation.

Water is injected since it is much less costly than steam and there is a need to maintain a positive pressure gradient to prevent oil resaturation in the previously flooded, oil depleted zone of the reservoir. The water injection will also serve to scavenge some of the heat remaining in the depleted zone and carry that heat to the higher oil saturation areas. Produced water can be used as a source of injection water.

After sufficient stimulation, the third well is converted to production and water injection is continued in the first well and steam injection is continued at the second well. About the time of steam breakthrough at the third well, the third well should be converted from a producer to a steam injection well and steam injected at the fourth well, while simultaneously injecting water through the first and second wells. Water injection is continued through the first and second wells, steam injection is continued through the third well and the fourth well is converted to a producing well. This process may be continued with additional horizontal wells until the formation has been completely swept by the steam and water flood front or until the desired of the formation has been swept.

FIG. 1 and 2 illustrate a formation penetrated by substantially horizontal wells 11, 12, 13 and 14. FIG. 2 is a side view taken along line 2—2 of FIG. 1. These figures illustrate the injection and production sequence of the invention. These figures are not drawn to scale.

In FIG. 2, horizontal wells 11, 12, 13 and 14 are shown drilled through the formation 15. Their respective wellheads 17, 18, 19 and 20 are shown above the ground 16. FIG. 2 is not intended to suggest any particular type of wellhead.

The first step is injecting steam into wells 11 and 12. Steam injection in continued through well 11 and production is then initiated through horizontal well 12. About the time of steam breakthrough at well 12, production through well 12 is stopped and steam is injected through wells 12 and 13. Water is injected instead of steam through well 11. After a suitable period of time, well 13 is then placed on production.

A different embodiment to the invention entails altering the step process after the third well has been placed on production. About the time of steam breakthrough with the third well, the second well is converted to water injection from steam injection and water injection is continued at the first well while production is continued past steam breakthrough at the third well.

If vertical wells have been drilled into the formation, the vertical wells may be employed to supplement injection and production operations. In fact, it is possible to substitute one or more vertical wells for a horizontal well in the invention process.

The invention process is particularly attractive for heavy oil reservoirs having a thickness less than about 30 feet. For such thin reservoirs, it is usually uneconomical to employ steam floods with conventional vertical wells because of the limited perforation interval of the well in the pay zone. Well spacing for vertical wells in a 20 foot wide pay zone would have to be very small, approximately 2.5 acres per well or less, in order to have an effective steam flood. Such a high well density would normally cause the project to be uneconomical. If the vertical well spacing is increased, the drilling cost could be reduced but at the cost of excessive heat loss to the formation and poor vertical conformance.

The use of parallel horizontal wells to produce a thin reservoir changes the economics of steam flooding. A horizontal well extending 400 feet through the formation could have 20 times the perforation length of a vertical well in a 20 foot thick pay zone. As a general rule, the cost of drilling a horizontal well is approximately three times the cost of drilling a vertical well. Therefore, horizontal wells are attractive in replacing vertical wells in thin reservoirs as long as the horizontal wells can offer performance similar to vertical wells.

The diameter and length of the horizontal wells and their perforation intervals are not critical, except that such factors will affect the well spacing and the economics of the process. Such decisions should be determined by conventional drilling criteria, the characteristics of the specific formation, the economics of a given situation and the well known art of drilling horizontal wells.

Such horizontal wells must extend from the surface and run a substantially horizontal distance within the hydrocarbon formation. The optimum number of horizontal wells and their distance from each other and from other vertical wells which may also be employed is a balance of economics criteria. Perforation size will be a function of other factors such as flow rate, temperatures and pressures employed in a given operation. Preferably, the horizontal wells will be extended into the formation at a position near the bottom of the formation.

The process may also be employed in a dipping reservoir. With such a formation, the horizontal wells are preferably drilled perpendicular to the angle of the dip and the reservoir flooded from the updip end to the downdip end. This preferred method of dealing with dipping reservoirs, however, is not essential. Other reservoir conditions, such as naturally occurring boundaries, may make it worthwhile to drill the horizontal wells at some angle other than perpendicular to the angle of the dip for the practice of the invention.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

What is claimed is:

1. A process for recovering hydrocarbons from an underground hydrocarbon formation, which comprises drilling and completing at least three wells, a first well, a second well and a third well, into an underground hydrocarbon formation, with a portion of said wells extending through the formation in a substantially horizontal direction, said wells being substantially parallel to each other and spaced apart from each other in a substantially horizontal direction, said second well being positioned in the formation between the first and the third wells;

injecting steam into the formation through the first and second wells;

continuing steam injection through the first well and producing formation hydrocarbons through the second well;

injecting water into the formation through the first well and injecting steam through the second and third wells about the time of steam breakthrough at the second well; and continuing water injection through the first well and steam injection through the second well and producing formation hydrocarbons through the third well.

2. The process of claim 1, further comprising discontinuing steam injection through the second well and starting water injection through the second well about the time of steam breakthrough at the third well.

3. The process of claim 1, wherein the process is conducted in a dipping reservoir and the first well is updip of the second well.

4. The process of claim 1, wherein the wells are drilled into a hydrocarbon formation having a thickness less than about thirty feet.

5. The process of claim 1, further comprising drilling and completing a fourth well into the hydrocarbon formation, a portion of which extends through the formation in a substantially horizontal direction, said fourth well being substantially parallel to said third well and said third well being positioned between the second and fourth wells.

6. The process of claim 5, further comprising injecting water through the first and second wells and injecting steam through the third and fourth wells about the time of steam breakthrough at the third well.

7. A process for recovering hydrocarbons from an underground formation, which comprises:

drilling and completing at least four wells, a first well, a second well, a third well and a fourth well, into an underground hydrocarbon formation, with a portion of said wells extending through the formation in a substantially horizontal direction, said wells being substantially parallel to each other and spaced apart from each other in a substantially horizontal direction, said second well being positioned in the formation between the first and the third wells and said third well being positioned in the formation between the second and the fourth wells;

injecting steam into the formation through the first and second wells;

continuing steam injection through the first well and producing formation hydrocarbons through the second well;

injecting water into the formation through the first well and injecting steam through the second and third wells about the time of steam breakthrough at the second well;

continuing water injection through the first well and steam injection through the second well and producing formation hydrocarbons through the third well;

injecting water through the first and second wells and injecting steam through the third and fourth wells about the time of steam breakthrough at the third well; and injecting water into the formation through the first and second wells, injecting steam through the third well and producing hydrocarbons at the fourth well.

* * * * *